US008127513B2

(12) United States Patent
Gibbs

(10) Patent No.: US 8,127,513 B2
(45) Date of Patent: Mar. 6, 2012

(54) MOUNTING SYSTEM FOR ROOFS AND THE LIKE

(76) Inventor: Alden T. Gibbs, Wilmington, DE (US)

( * ) Notice: Subject to any disclaimer, the term of this patent is extended or adjusted under 35 U.S.C. 154(b) by 545 days.

(21) Appl. No.: 12/029,017

(22) Filed: Feb. 11, 2008

(65) Prior Publication Data

US 2008/0196346 A1 Aug. 21, 2008

Related U.S. Application Data

(60) Provisional application No. 60/890,029, filed on Feb. 15, 2007.

(51) Int. Cl.
*E04D 3/36* (2006.01)
*E04D 1/34* (2006.01)

(52) U.S. Cl. ..... 52/547; 52/489.1

(58) Field of Classification Search ..... 52/302.1, 52/530, 520, 538, 551, 173.3, 519, 543, 547, 52/552, 553, 489.1
See application file for complete search history.

(56) References Cited

U.S. PATENT DOCUMENTS

| | | | | | |
|---|---|---|---|---|---|
| 718,165 | A | | 1/1903 | Sneden | |
| 1,270,905 | A | * | 7/1918 | White | 52/547 |
| 1,582,281 | A | * | 4/1926 | Boyle et al. | 52/546 |
| 1,709,376 | A | * | 4/1929 | Shirley | 52/459 |
| 1,738,006 | A | * | 12/1929 | Houghton | 52/546 |
| 3,624,975 | A | | 12/1971 | Morgan | |
| 3,640,044 | A | | 2/1972 | Watts | |
| 3,735,543 | A | * | 5/1973 | Simon | 52/553 |
| 4,382,435 | A | | 5/1983 | Brill-Edwards | |
| 4,422,278 | A | | 12/1983 | Fujihiro et al. | |
| 4,476,659 | A | * | 10/1984 | Player | 52/404.1 |
| 4,548,011 | A | | 10/1985 | Martin | |
| 4,782,639 | A | | 11/1988 | Ferguson | |
| 4,890,432 | A | * | 1/1990 | Shepherd | 52/314 |
| 5,577,360 | A | | 11/1996 | Gibbs | |
| 5,617,690 | A | * | 4/1997 | Gibbs | 52/518 |
| 5,642,596 | A | * | 7/1997 | Waddington | 52/546 |
| 5,713,158 | A | | 2/1998 | Gibbs | |
| 5,746,029 | A | * | 5/1998 | Ullman | 52/27 |
| 5,758,428 | A | | 6/1998 | Kotlinski | |
| 5,794,396 | A | * | 8/1998 | Gibbs | 52/518 |
| 5,990,414 | A | * | 11/1999 | Posnansky | 136/244 |
| 6,052,961 | A | * | 4/2000 | Gibbs | 52/518 |
| 6,453,629 | B1 | * | 9/2002 | Nakazima et al. | 52/173.3 |
| 6,463,708 | B1 | * | 10/2002 | Anderson | 52/521 |
| 6,521,821 | B2 | * | 2/2003 | Makita et al. | 136/244 |
| 6,570,084 | B2 | * | 5/2003 | Dinwoodie | 136/251 |
| 6,883,290 | B2 | * | 4/2005 | Dinwoodie | 52/748.1 |
| 7,155,870 | B2 | * | 1/2007 | Almy | 52/544 |
| 7,168,215 | B1 | * | 1/2007 | Bednarczyk | 52/478 |
| 7,178,295 | B2 | * | 2/2007 | Dinwoodie | 52/173.3 |
| 2003/0154666 | A1 | * | 8/2003 | Dinwoodie | 52/173.3 |
| 2005/0098697 | A1 | | 5/2005 | Collins | |

FOREIGN PATENT DOCUMENTS

| | | |
|---|---|---|
| AU | B-60521/94 | 4/1994 |

* cited by examiner

*Primary Examiner* — Khoi Tran
*Assistant Examiner* — Jason Holloway
(74) *Attorney, Agent, or Firm* — Connolly Bove Lodge + Hitz

(57) ABSTRACT

A mounting system for mounting a plurality of panels to a roof structure includes a plurality of rows of panels wherein at least some of the rows are arranged in overlapping fashion. Spacer structure is provided between the rows of panels to maintain vertically adjacent panels out of contact with each other to create an open area for an air layer between the vertically adjacent panels.

15 Claims, 5 Drawing Sheets

MOUNTING SYSTEM FOR ROOFS AND THE LIKE

CROSS-REFERENCE TO RELATED APPLICATION

This application is based upon provisional application Ser. No. 60/890,029, filed Feb. 15, 2007, all of the details of which are incorporated herein by reference thereto.

BACKGROUND OF THE INVENTION

U.S. application Ser. No. 11/560,409 filed Nov. 16, 2006, describes various techniques for mounting panels, such as slate, to different forms of roof structure. One of the techniques involves the use of spacers to create an open area or air layer between vertically adjacent panels.

SUMMARY OF THE INVENTION

An object of this invention is to provide further techniques for creating an open area or air layers between panels in addition to what is described in the above noted application.

The present invention in its broad form utilizes spacers between vertically adjacent panels or slates or other roofing shingles/tiles to create an open area or air layer between the panels. In various practices of this invention the spacers may take different forms. In addition, in a preferred practice of the invention, the techniques are used with double overlap panel arrangements. It is also a preferred practice of this invention to have the spacers shielded or concealed so as to minimize exposure to weather conditions.

DRAWINGS

DETAILED DESCRIPTION

The present invention is based upon the concept of providing spacers to create an open area or air layer between vertically adjacent panels. The invention could be practiced by the use of separate spacers which could be of any suitable size, shape and material and could be mounted to the panels in any suitable manner. The invention could also be practiced by utilizing the fasteners which mount the panels to the roof to additionally function as spacers. What is important in the broad practice of this invention is that the spacers are located between vertically adjacent panels so as to cause each panel to be spaced away from and out of contact with its vertically adjacent panel and thereby permit the creation of the air layer.

Figure 1:
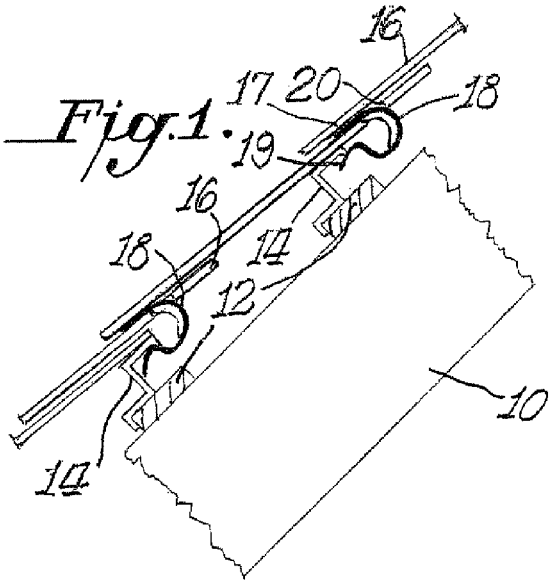
FIG. 1 is a side elevational view partly in section of a portion of a roof in accordance with this invention.

Reference is made to copending application Ser. No. 11/560,409 filed Nov. 16, 2006, all of the details of which are incorporated herein by reference thereto. In that application a general mounting system in one practice of the invention includes the provision of tracks or pedestals mounted to the roof with fasteners securing the panels, such as slate or other roofing shingles, to the tracks. FIG. 1 illustrates such a practice of the invention. As shown therein the mounting structure includes framework which comprises roof joists or rafters 10. A plurality of battens 12 are mounted across the spaced rafters 10. FIG. 1 also illustrates a plurality of spaced parallel tracks or pedestals 14 mounted to the battens 12. The individual panels 16 are secured through use of fasteners 18 which engage the panels 16 and the track 14. For example, in the illustrated practice of FIG. 1 the tracks 14 are of Z-shape while the fasteners are resilient clips of R-shape. Each panel 16 is provided with slots or kerfs 20 in its side edges. The fastener 18 is inserted into the kerf with the straight leg 17 above the panel and the curved leg 19 is located below the outer upper portion of the track 14. FIG. 1 shows the fastener 18 fully engaged in the lower portion of the figure, while the fastener 18 is in the process of being mounted in the upper portion of the figure.

In the embodiment shown in FIG. 1, as described in the aforenoted application, the fasteners 18 function not only as structure for mounting the panels to the tracks, but also function as spacers where the upper leg 17 is a straight leg of each clip fastener 18 and is of sufficient thickness to space an upper panel 16 from its vertically adjacent lower panel 16.

Where a fastener, such as a generally R-shaped clip, is used, the clip could take various forms including the form shown in FIG. 1. A variation would be for the upper or straight upper leg of the clip to be bent slightly up. By bending the clip upwardly the space between the adjacent panels is increased. Accordingly, the clip could fit snugly in the kerf 20 with only the upwardly bent portion extending outwardly from the panel or the entire or most of the free upper leg could extend above the panel.

Figure 1B:
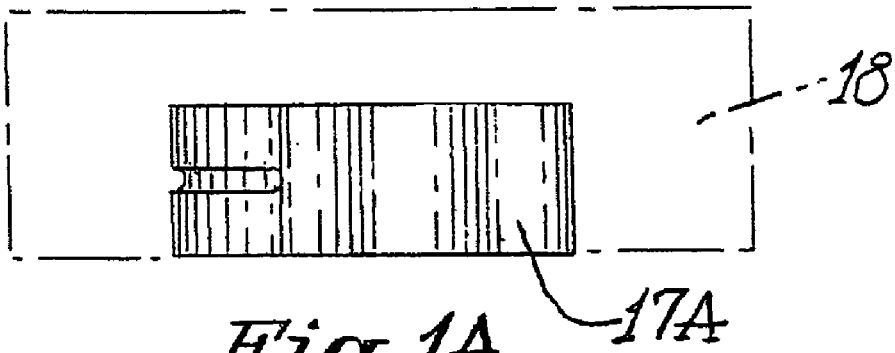
FIGS. 1A-1D are side elevational and plan views respectively of two variations of the clip shown in FIG. 1.
Figure 1A:
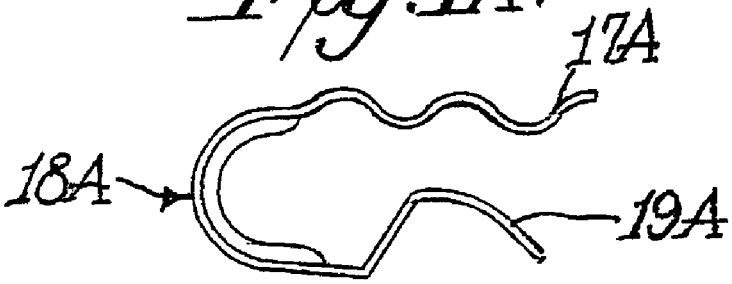

FIGS. 1A-1B illustrate a modified fastener 18A. As best shown in FIG. 1A the upper leg 17A is not straight, but rather wavy or undulated and terminates in its outer end being bent upwardly. This increases the spacing effect of the upper leg 17A as compared with the straight leg 17 in FIG. 1.

Figure 1D:
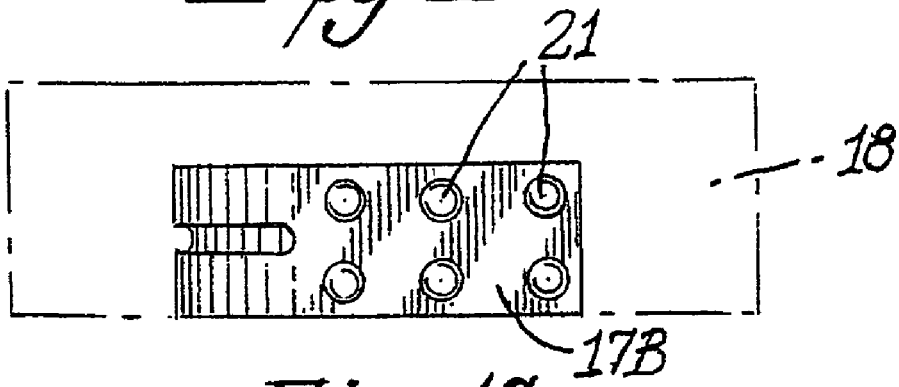
Figure 1C:
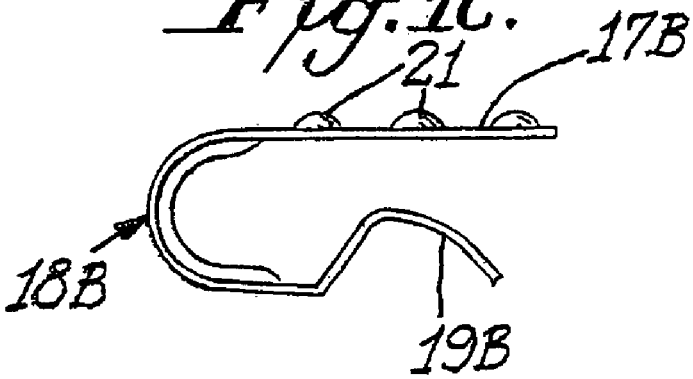

FIGS. 1C and 1D illustrate a further variation of fastener 18B. As best shown in FIG. 1C the upper leg 17B has sets of bumps or dimples 21 which add to the spacing ability of upper leg 17B.

The provision of additional structure on the upper leg, such as the upward curves of upper leg 17A or the bumps or dimples 21 of upper leg 17B enhances the spacing function of the clip. Where, for example, the upper leg is bent upwardly a dog leg results which departs from the surface of the panel 16. While the addition of such spacing structure, of which upper legs 17A and 17B are examples, may result in only a small departure from a completely straight upper leg, the effect is two-fold. One such effect is to raise beyond the thickness of the clip or fastener itself the overlying panel or slate. This increases the air gap that enhances air circulation and speeds drying. Another effect is to make this separation springy. Non-springy separators could present point loads that could be damaging. In contrast, a spring-like action whereby the clip could be flattened out if subjected to a load would effectively eliminate such point loads.

It is to be understood that the illustration of the clip abutting against the intermediate portion of the Z-shaped track 14 is merely for exemplary purposes. The invention could be practiced where a fastener or clip abuts against the upper or lower portions of the track instead of or in addition to abutting against the intermediate portion.

Although FIGS. 1C-1D illustrate the auxiliary spacing structure to be in the form of bumps or dimples other structure could also be used such as ridges which extend across a longer portion of the upper leg 17B. Such structure could extend upwardly and/or downwardly from the upper leg.

FIGS. 1-1D illustrate the lower leg 19, 19A, 19B of the clip to be a curved ramp. This results in overcoming a problem that might exist with a straight ramp. For example, such resilient clips are intended to handle a range of thicknesses. Thick panels require the clip to open significantly in order to snap onto the track. The significant opening causes the ramp to point downwardly toward the roof structure. The more the clip opens the closer it comes to being perpendicular to the leg of the track onto which the clip is meant to snap. A curved ramp, however, avoids this problem. Instead, a curved ramp presents a gentler slope to the nose of the track thus facilitating and even enabling installation of thick panels or slates.

Figure 2:
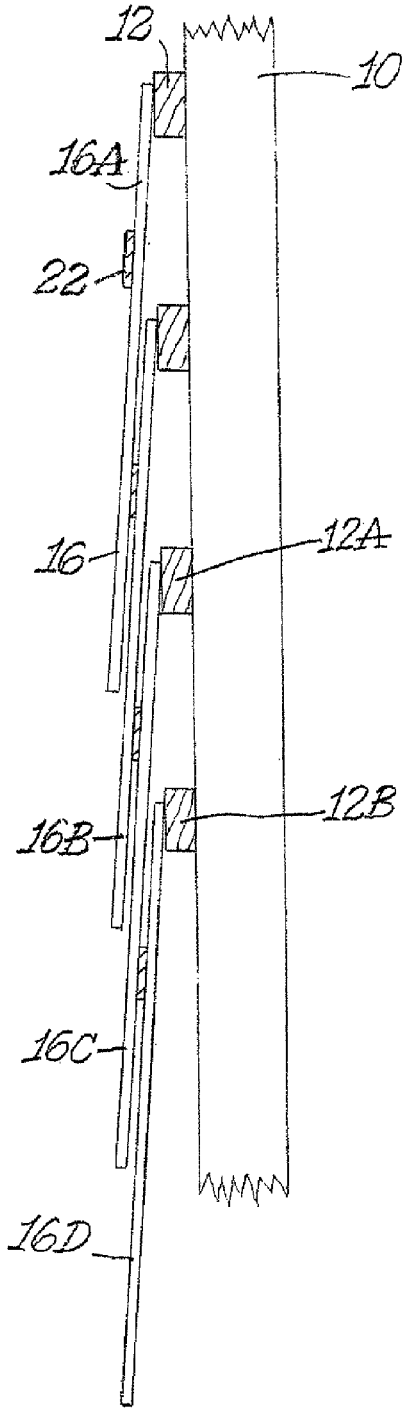
FIG. 2 is a side elevational view similar to FIG. 1 with a variation in the roof structure.

The invention may also be practiced where the spacers are separate members which may be used with the types of fasteners shown in FIG. 1 or may be used in any other type of mounting arrangement. FIG. 2, for example, shows a practice of the invention wherein the panels 16 are mounted directly to the battens 12 which are mounted across the rafters 10 without the use of a track/fastener system. (Although such practice could be done in a track/fastener system.) Such mounting could be done in any conventional manner through the use of known fasteners such as nails, screws, staples, etc. The spacing of the panels 16 from each other is accomplished through the use of separate spacer members 22 which could be of any suitable size, shape and dimension. What is important is that the spacers are sufficiently thick to create the open area or air layer between adjacent panels without being too thick. In the preferred practice of this invention the thickness of the spacers and more particularly the thickness of the open area or air layer between adjacent panels is 10 millimeters or less. More preferred practices would be thicknesses no greater than 8 millimeters or 6 millimeters. An acceptable range of thickness could also be no greater than 4 millimeters.

In the arrangement shown in FIG. 2, individual horizontal rows of panels are labeled 16A, 16B, 16C and 16D going from top to bottom. The rows of panels adjacent to each end of the roof might be considered as outer rows while the rows of panels between them might be considered as intermediate rows. The intermediate rows would occupy the major portion of the roof. As illustrated in FIG. 2 there is a double overlap in the intermediate rows. In that regard, for example, the panels are arranged to overlap each other in such a manner that the heel of panel 16A is located above an intermediate central portion of panel 16B which in turn is located above the head of panel 16C at the batten labeled as 12A. A similar double overlap results at batten 12B. Except for the most outer rows of panels another characteristic of the mounting arrangement is that the spacers 22 are completely concealed so as not to be exposed to weather conditions.

As is apparent from the drawings, the invention could be practiced with various roof structures such as where the panels are mounted directly on tracks or directly to the battens or against a deck, etc.

FIG. 2 illustrates the practice of the invention where a single spacer is provided against each panel. The invention could be practiced where there are a plurality of spacers suitably located at different locations on each panel. For example, the plurality of spacers could be laterally and/or longitudinally aligned or could even be randomly located with respect to each other. Preferably, whatever the location is it should be where the spacers are concealed. It is to be understood, however, that the invention could be broadly practiced where the spacers are not concealed.

The head of the panels could be mounted to a batten, a track, a track segment (pedestal) or a prominence from a deck structure or other form of support and the support near the heel or tail at the bottom end of the panel could be either one or more spacers or one or more fasteners that also function as spacers.

The spacers could take various shapes, such as being C or U shaped which could be snapped onto the upper leg of a track. This would have the effect of placing spacers are intervals that coincide with the heads of the panels or slates. The result would be an elevation of the panel above the level of the track, acting in effect like a pedestal. The spacers could be either unitary in the sense of one spacer per panel or continuous. A continuous spacer could be, for example, a continuous strip with rises and valleys. This undulating or crenellated strip could be snapped on a track just as a unitary "C" section could be. The apexes of the crenellations or rises could be located to occur one or more times per panel to create the open spaces for air flow.

Unitary and continuous spacers could be made to mount on the track, battens, decking or other support surfaces in a variety of ways. They could be screwed, nailed, stapled, glued, taped or otherwise attached. The spacers could also be laid loosely and held in place by the positioning of the panels or other elements. It is not necessary to surround a track element as would result from a C-shaped spacer.

Figure 3:
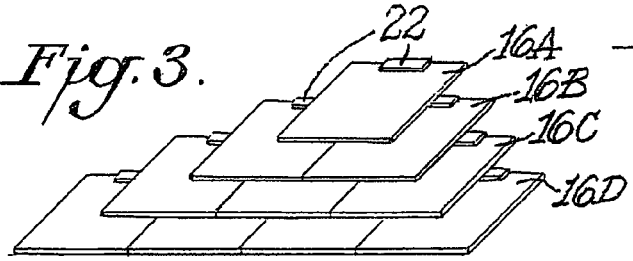
FIG. 3 is a perspective view of a roof mounting system utilizing spacers in accordance with a further practice of this invention.
Figure 4:
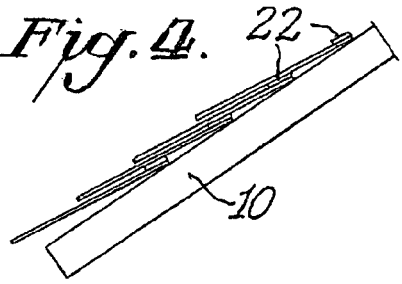
FIG. 4 is a side elevational view of the practice shown in FIG. 3.

FIGS. 3-4 illustrate a practice of the invention wherein there is a double overlap of the intermediate rows of panels 16A-16D. The spacers 22 are laterally centrally located at the head portion on top of a panel in each row at the location where the juxtaposed panels of the lower row abut. Thus, for example, the spacer on panel 16C would be located at the head of that panel along its center line which coincides with the location where two lower panels 16D abut each other. This creates a spacing between the row of panels 16B and 16C. A similar spacing between row of panels 16C and 16D would be created by the spacer 22 at the head of each lower panel 16D. As shown in FIG. 4 each spacer is a pad of material which is confined to the head of its panel. FIG. 3 shows the spacers to be of generally rectangular shape. It is to be understood that other shapes could also be used.

The arrangement of FIGS. 3-4 could be practiced where there are more than one spacers on each panel or where there is a single spacer that extends the length of the entire row of panels or at least across multiple panels when, for example, the spacer is of undulated shape to create air passageways.

Figure 5:
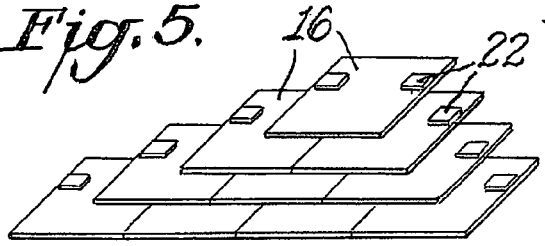
FIG. 5 is a view similar to FIG. 3 of yet another practice of this invention.
Figure 6:
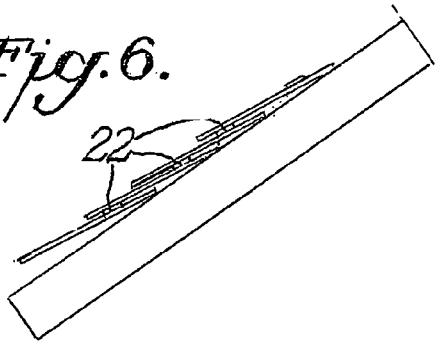
FIG. 6 is a side elevational view of the practice shown in FIG. 5.

FIGS. 5-6 show a variation where the spacers 22 are located at each edge of each panel downwardly from the upper edge of the panel head. As illustrated in FIG. 5 a pair of spacers is provided on each panel. The invention could be practiced where only a single or more than two spacers are utilized. Where more than one spacer is used it is not necessary that the spacers be aligned with each other.

Figure 7:
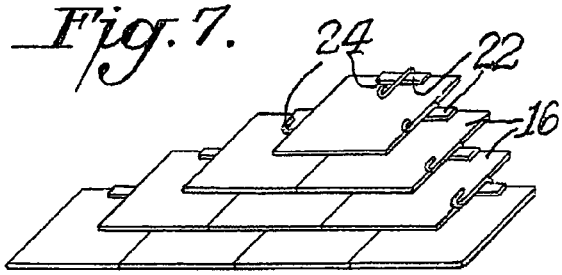
FIGS. 7-8 are perspective views similar to FIGS. 3 and 5 of yet further practices of this invention.

FIG. 7 shows how the spacers 22 could be used in conjunction with known components such as hook 24 as described in U.S. Pat. Nos. 5,794,396 and 6,052,961, all of the details of which are incorporated herein by reference thereto.

The combination hook/spacer shown in FIG. 7 has a number of distinct advantages. For example, because the spacer 22 would extend across and below the overlying panels, the spacer interconnects the panels and thereby strengthens the attachment. The spacers separate the panels slightly, breaking capillary action which allows for a greater margin of safety or a reduced headlap. In addition, the spacers free trapped water which reduces aging and prolongs panel or slate life. Further the spacers increase roof breathability and prevent capillary rise along the hook shank.

Figure 9:
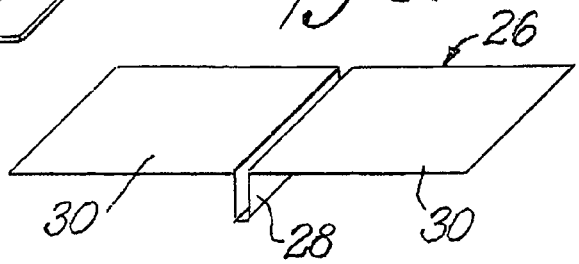
FIG. 9 is a perspective view of the spacer shown in FIG. 8.
Figure 8:
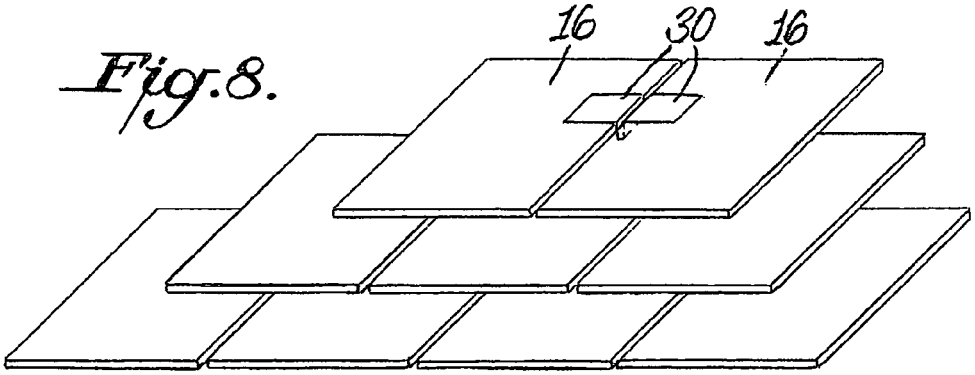

FIGS. 8-9 illustrate another practice of the invention wherein the spacer 26 is formed from a U-shaped base 28 having flat wings 30 extending from each side at the top of the U. The base 28 would be snapped between adjacent panels 16 with the wings 30 overlying the panels. The wings would be of sufficient thickness to create the desired spacing.

Figure 9B:
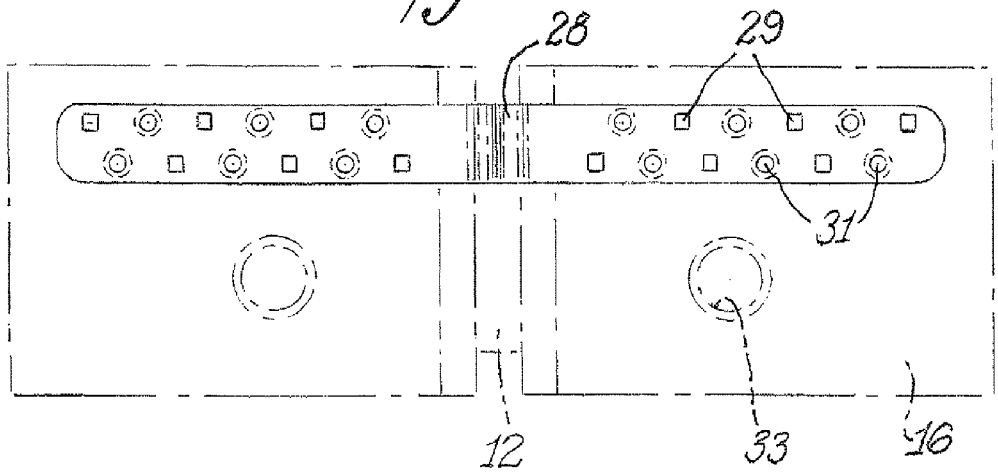
FIG. 9B is a top plan view of the spacer shown in FIG. 9A.
Figure 9A:
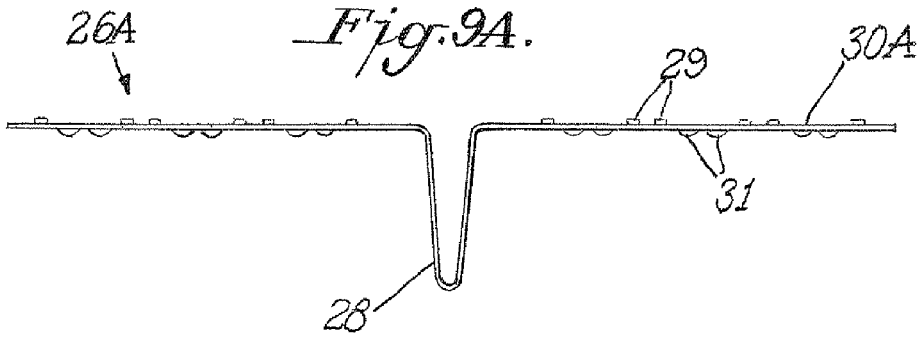
FIG. 9A is a side elevational view of a modified form of spacer similar to that shown in FIG. 9.

FIGS. 9A-9B show a spacer 26A which is a modified form of the spacer shown in FIGS. 8-9. As illustrated in FIGS. 9A-9B the wings 30A additionally include upwardly extending projections 29 and/or downwardly extending projections 31 which could be of any suitable form such as the spaced dimples or bumps illustrated therein. The provision of these projections increases the degree of spacing achieved by spacer 26A. The panels 16 may include recessed holes 33 for receiving the fasteners, such as a nail or rivet and permitting the head of the fastener to be flush with the outer surface of the panel.

Figure 10:
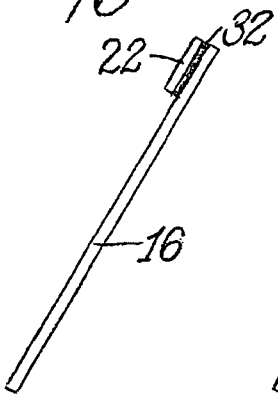
FIGS. 10-13 are side elevational views of various forms of spacers.

FIGS. 10-13 illustrate various forms of spacer structure and location. As shown in FIG. 10 the spacer 22 is a pad or block which would be mounted directly to one surface of the panel 16 in any suitable manner such as by an intermediate adhesive layer 32.

Figure 11:
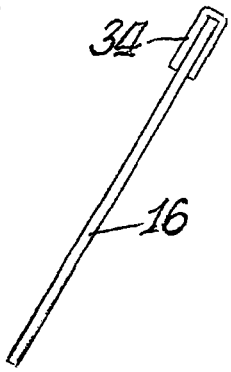

FIG. 11 shows a spacer 34 which is generally U or C-shaped to snap over the head of a panel 16.

Figure 12:
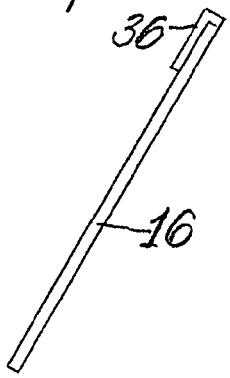

FIG. 12 illustrates a spacer 36 which is of generally L-shape fitting over the head of panel 16, but extending only to the lower surface of panel 16 while the main portion of the spacer is on the upper surface.

Figure 13:
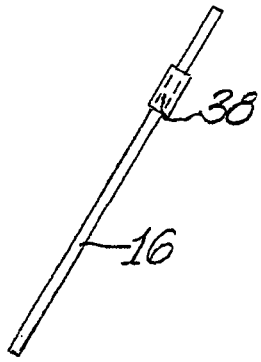

FIG. 13 illustrates a C or U-shaped spacer 38 which is snapped along the edge of the panel 16.

Figure 15:
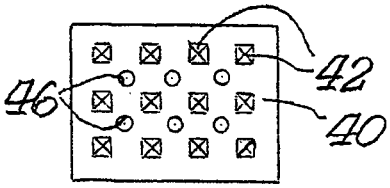
FIG. 15 is a top plan view of the spacer shown in FIG. 14.
Figure 14:
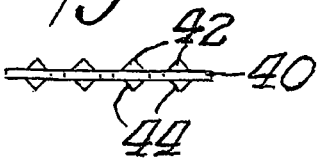
FIG. 14 is a side elevational view of yet another form of spacer in accordance with this invention.

FIGS. 14-15 illustrate a form of spacer 40 which is a pad or block having a series of preferably pointed or conical protrusions 42 extending upwardly and protrusions 44 extending downwardly. The spacer 40 could alternatively have either a single set of upwardly extending protrusions 42 or downwardly extending protrusions 44 or a combination of both. Optionally, through holes 46 could be formed through the block or spacer 40 to enhance air flow.

Figure 16:
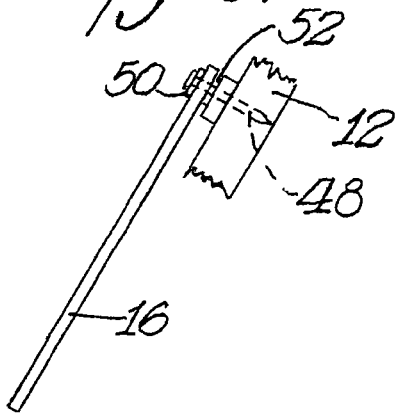
FIG. 16 is a side elevational view of yet another practice of this invention.

FIG. 16 illustrates a practice of the invention where a panel 16 is secured to, for example, a batten 12 by any suitable fastener such as a nail 48. In this practice of the invention a spacer in the form of a washer 50 is mounted between the nailhead and the panel 16 to create the space. Alternatively, or in addition, a further washer 52 could be located between the panel 16 and the batten 12. The washer could take any suitable shape. For example, the washer or spacer need not encircle the nail or fastener, but could be arms located at such fastener. What is characteristic of the washer is that it fits at least partially around the fastener 48 so that the fastener 48 functions not only to mount the panel to the roof, but also to hold the spacer in place.

While FIG. 16 specifically illustrates the fastener as being in the form of a nail used in connection with at least one washer to achieve the spacing function, other forms of fasteners can be used such as a rivet wherein the rivet head itself could be of sufficient thickness and extend above the panel a sufficient distance to act as a spacer instead of or in addition to one or more washers.

While various figures, such as FIGS. 1C and 9A, illustrate the spacer structure to be in the form of bumps, it is to be understood that other spacers or structures could be used which would provide capillary breaks which could, for example, be molded into manufactured panels or slates. The various drawings illustrate different locations for the spacer elements. It is to be understood that such locations could include, for example, a spacer that rests beneath the end of a panel or slate or could include a spacer held above the panel or slate being held in place by a conventional hook with the structure being a hook then a spacer then a panel. In addition, the spacer could be above the panel or slate structure that rests in the hooks shank's joint to prevent rotation and dislodging or the spacer could be located above and attached to the hook. Such added elements, such as spacers or hooks could be made of copper or other materials that leach in order to suppress growth on the shingles or panels.

The various forms of spacers described herein could include a bent leg or wing or other structure that rises above the surface or extends below the surface of the leg of the fastener or clip so that there is a compliant or flexing separation which is reduced upon loading.

The invention could be practiced using a spacer which may wrap around the panel or slate by, for example, being at the side edge of the panel or the fit of the spacer may be such that the nature of the engagement creates an elevated spring-like structure such as a U-shaped that does not fully close around the panel or slate.

Advantageously the present invention could be practiced by providing suitable spacers on new roof construction. In addition, the invention could be practiced for replacement or repair of existing roofs.

As previously noted, while the invention may be practiced with relatively small spacers occupying only a small portion of a panel, the spacers could be of larger form and dimension, such as being a thin, hard sheet with a raised grid with or without perforations. The sheet could be placed under the panels or shingles to facilitate air flow. The sheet could be packaged in roll form and unrolled when it is time to mount the sheet to the roof. Thus, for example, the various spacers shown in FIGS. 10-12 could be individual discrete spacers of small size where separate spacers are mounted on the panels or could be a continuous sheet which covers a plurality of panels.

What is claimed is:

1. A mounting system comprising a plurality of rows of panels, each of said panels having a head portion and a heel portion and opposite side edges, at least some of said rows of panels being arranged in overlapping fashion whereby a heel portion of one panel is located vertically above a head portion of a vertically lower panel, a mounting structure for mounting said rows of panels to a roof structure, a spacer structure between said rows of panels to create an open area for an air layer to enhance air circulation between said vertically adjacent panels, said spacer structure being separate and distinct from said mounting structure, said spacer structure being free of direct securement to the underlying roof structure, said spacer structure comprising a base portion fitting between horizontally adjacent panels, at least a portion of said base portion terminating above a lower panel, a pair of wing portions extending from said base portion, and each of said wing portions being disposed against a lower one of said vertically adjacent panels on the upper surface of said lower adjacent panel and against the upper one of said vertically adjacent panels at the lower surface of said upper one of said vertically adjacent panels to create said open area between said vertically adjacent panels.

2. The system of claim 1 wherein some of said projections extend downwardly from said wing portions.

3. The system of claim 1 wherein each of said wing portions includes outwardly extending projections.

4. The system of claim 3 wherein at least some of said projections extend upwardly from said wing portions.

5. The system of claim 3 wherein at least some of said projections extend downwardly from said wing portions.

6. The system of claim 1 including recessed holes in said panels for receiving fasteners which comprise part of said mounting structure to mount said panels to the roof structure.

7. The system of claim 1 wherein said base portion is snapped between said horizontally adjacent panels.

8. The system of claim 7 wherein said base portion is located outwardly of and parallel to said side edge of its respective horizontally adjacent panels.

9. The system of claim 8 wherein each of said side edges of said horizontally adjacent panels includes a slot/kerf which comprises part of said mounting structure, and said base portion of said spacer structure being located at a position along said side edge other than at the location of said slot/kerf.

10. The system of claim 9 wherein said mounting structure includes a plurality of spaced parallel tracks.

11. The system of claim 1 wherein said spacing structure comprises a one piece band bent into said base portion and said wing portions.

12. The system of claim 1 wherein said wing portions extend outwardly in opposite directions from the top of said base portion.

13. The system of claim 1 wherein said surfaces of said panels contacted by said wing portions are completely flat.

14. The system of claim 1 wherein said base portion extends downwardly from said wing portions parallel to said side edges of said horizontally adjacent panels and is located outwardly of and parallel to said side edge of its respective horizontally adjacent panels.

15. The system of claim 14 wherein each of said side edges of said horizontally adjacent panels includes a slot/kerf which comprises part of said mounting structure, and said base portion being located at a position along said side edge other than at the location of said slot/kerf.

* * * * *